United States Patent [19]

Crump

[11] Patent Number: 4,469,198

[45] Date of Patent: Sep. 4, 1984

[54] OUTSIDE RESCUE ELEVATOR SYSTEM FOR HIGH-RISE BUILDINGS

[76] Inventor: Robert F. Crump, 1503 Thackeray Dr., Louisville, Ky. 40205

[21] Appl. No.: 369,315

[22] Filed: Apr. 16, 1982

[51] Int. Cl.[3] ..... B66B 9/00

[52] U.S. Cl. ..... 187/8; 187/1 R; 187/11; 187/9 R; 187/88; 187/95; 187/6; 182/43; 182/82; 182/142; 169/48

[58] Field of Search ..... 187/6, 8, 1 R, 88, 9, 187/11, 73, 80, 86, 95; 182/82, 142, 141, 43; 169/48

[56] References Cited

U.S. PATENT DOCUMENTS

| | | | |
|---|---|---|---|
| 745,915 | 12/1903 | Scully | 169/2 X |
| 780,711 | 1/1905 | Donnell | 187/6 |
| 1,138,902 | 5/1915 | Smith | 187/88 X |
| 2,618,361 | 11/1952 | Zindt | 187/88 |
| 3,517,774 | 6/1970 | Meyer | 187/6 |
| 4,018,306 | 4/1977 | Lyons | 187/1 R X |
| 4,315,456 | 2/1982 | Hayashi et al. | 169/48 X |

*Primary Examiner*—Joseph J. Rolla
*Attorney, Agent, or Firm*—Richard L. Caslin

[57] ABSTRACT

An outside rescue elevator system is shown for use on a high-rise building. The elevator system can be installed on existing buildings, as well as being included in new construction. The system includes a dual compartment track mounted vertically on the outside of the building, and a wheeled truck operating within one of the track compartments, and a dual cable system is included with the truck for raising and lowering the truck within the track. A portable elevator cab is connected to the truck, and the cab includes a pair of stabilizing wheels, so that the cab actually rides on a smooth vertical roadbed that extends up the exterior wall of the building. The elevator cab is provided as part of a mobile unit which includes a self-propelled truck, a motor/generator set mounted on a trailer that is pulled by the truck, so that the mobile unit may be stored in a remote location such as a fire department station house, and brought to the scene of a fire emergency at one of a plurality of high-rise buildings that is serviced by this safety system. The motor/generator set serves as an independent power supply for the cable hoist system of the building. Suitable safety measures are employed for maximum security. An important phase of this system is the provision of refuge areas on predetermined floors within the building in cooperation with the outside rescue elevator system for protecting the occupants of the building from smoke and fire during the rescue operation.

11 Claims, 19 Drawing Figures

FIG. 7
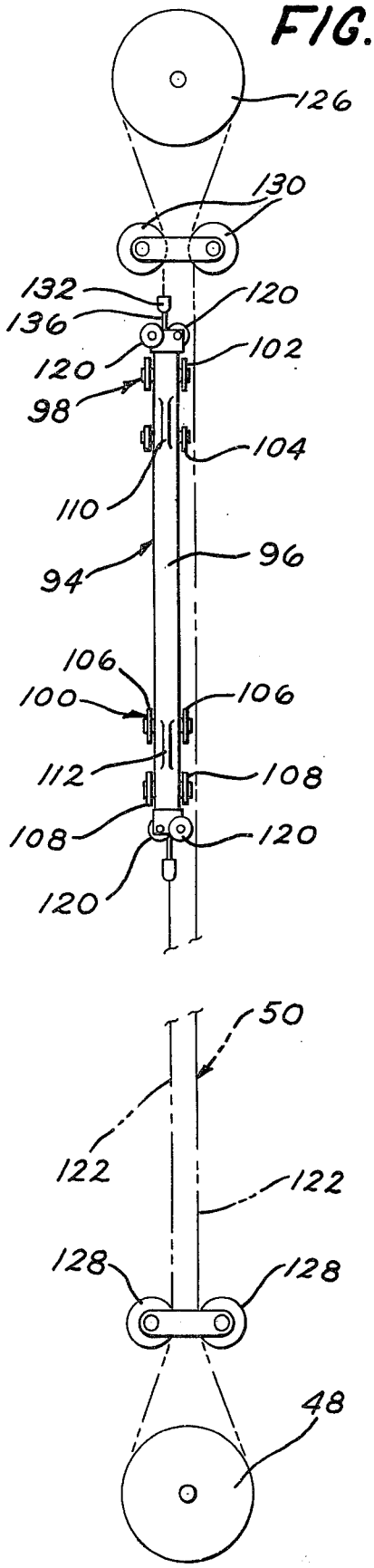
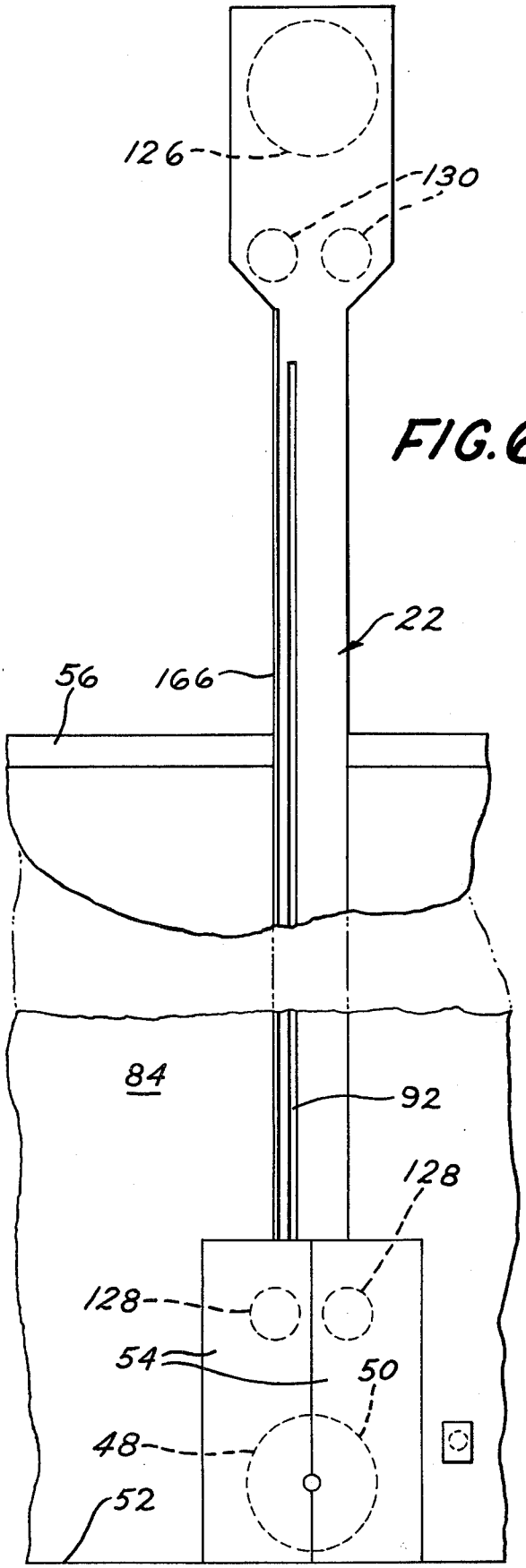
FIG. 6

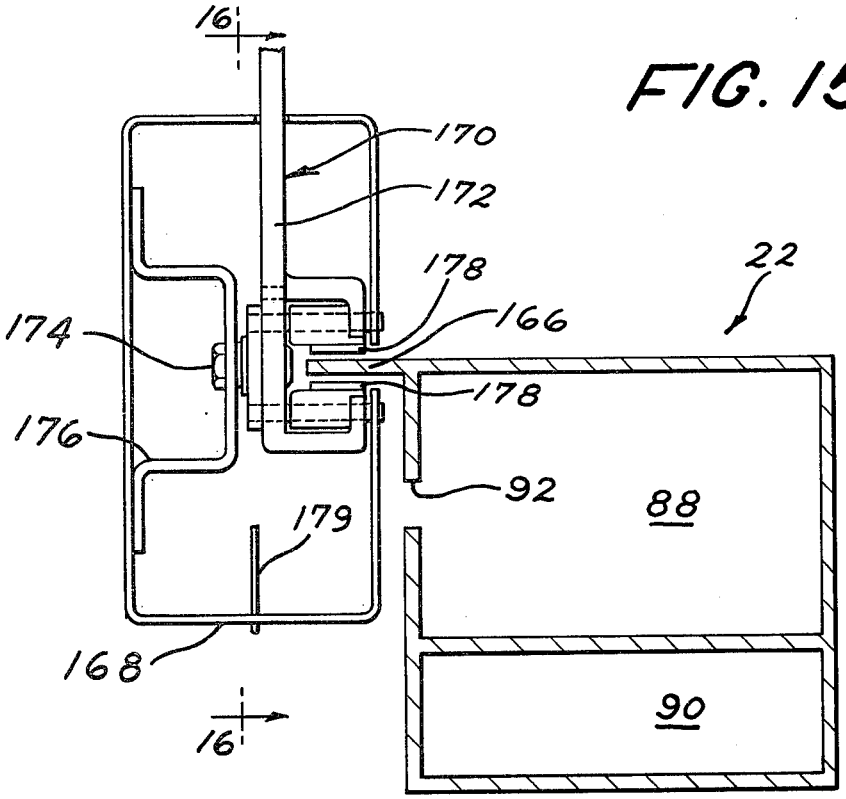
FIG. 15
FIG. 16
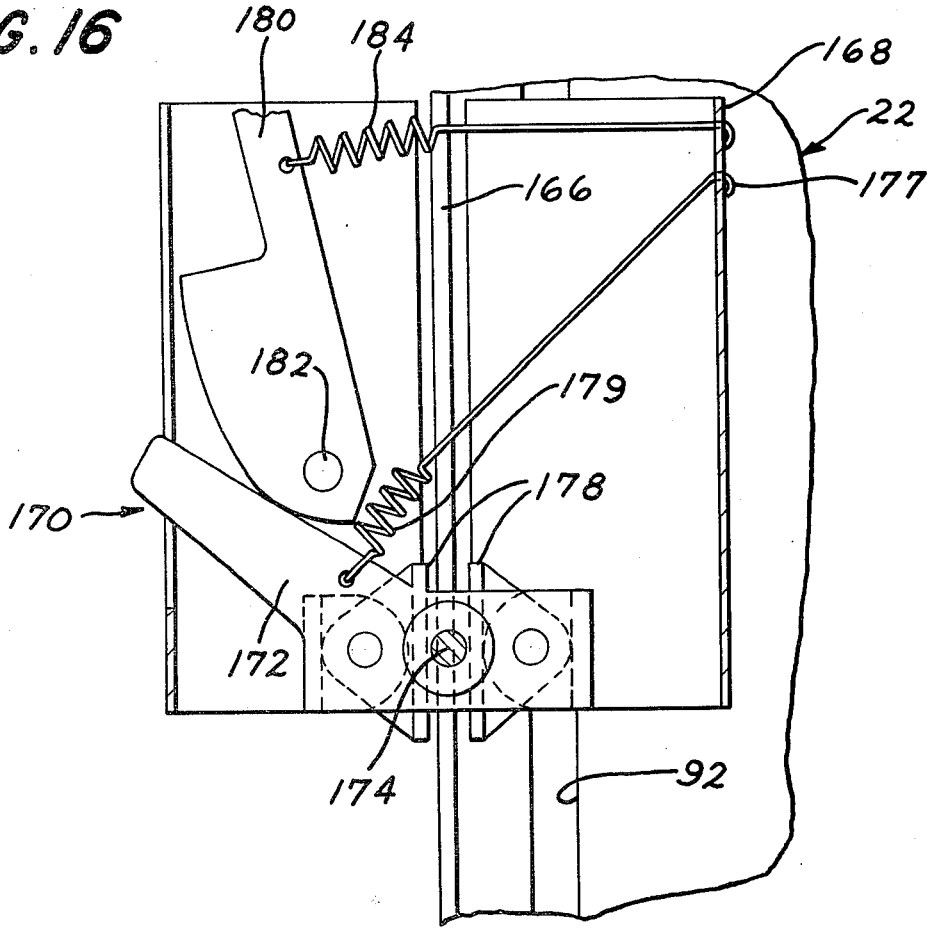

OUTSIDE RESCUE ELEVATOR SYSTEM FOR HIGH-RISE BUILDINGS

BACKGROUND OF THE INVENTION

1. Field of the Invention

This invention relates to outside rescue elevators for high-rise buildings, and particularly to a system using an exterior track permanently-positioned on the outside wall of the building, and having an associated cable drive for a separate portable elevator cab that travels up the outside of the building, where the cable drive obtains its power from a portable motor/generator unit that is either self-propelled or towed by a vehicle to the scene of the emergency.

2. Description of the Prior Art

Outside rescue elevators are known in the prior art. An early patent is that of Donnell U.S. Pat. No. 780,711, which issued in 1905. This patent teaches a single track made up of a continuous guideway that is permanently-positioned on the street side of the building, and having an elevator cab permanently-mounted to the guideway by guide shoes. The cab is stored within a shed or housing at the upper end of the track when not in use. A cable system is furnished for moving the elevator cab where it is needed for bringing the occupants of the building down from the windows or other exits by means of the elevator cab. One end of the cable is wound around a pulley that is mounted on the exterior wall of the building at street level, and a hand crank is made available as the source of power. This invention came before the invention of the electric motor or the internal combustion engine.

The Collins U.S. Pat. No. 2,122,908 describes a hoist for fire-fighting purposes in a multi-storied building. A hollow guide member is permanently-attached to the exterior wall of the building and is formed by a series of connected pipes. The single hollow guide member or track includes a self-contained cable-operating system having a traveler that moves up and down the track. The traveler includes a bracket and platform permanently attached thereto. A self-propelled truck is provided with a driven sheave for engaging the cable of the track and providing the motive force for the traveler of the hollow guide member or track. A portable elevator cab is carried by the truck and may be mounted on the bracket of the traveler.

The Bernett U.S. Pat. No. 2,647,675 describes fire rescue apparatus that is adapted to be transported to a fire and then travel up and down the sides of a building to rescue persons therefrom in time of need. A vertical I-beam is permanently mounted to the exterior wall of the building. A portable elevator cab is provided for engagement with the track or I-beam, and this cab is in the form of a self-propelled vehicle that has ground wheels for transporting the vehicle to the point of use. This vehicle also serves as the elevator cab, and it has means for moving the vehicle up and down the track of the building wall. The track includes an elongated rack formation for the entire length, and pinion gears are provided on the vehicle which mesh with the rack to carry the vehicle up and down the exterior wall of the building.

The Meyer U.S. Pat. No. 3,517,774 describes a single tubular track of polygonal cross section permanently affixed to the exterior wall of a building. A carriage is permanently installed inside of the track, and there is a cable system also within this single track for raising and lowering the carriage within the track. An elevator cab is removably attached to the carriage through a front slot extending the length of the tubular track. Power is supplied to the lower pulley assembly by a reversible motor housed within a removable power unit that is positioned at ground level. A safety brake mechanism is mounted on the carriage.

The Moulson et al U.S. Pat. No. 3,757,897 describes a vertically-moving transporting apparatus for high-rise buildings. This apparatus includes a lift unit that is adapted to travel up and down a pair of tracks mounted on an exterior wall of a building. This lift unit has securing means for releasibly connecting a container that is basically in the form of a "less than carload lot" (LCL) container. This apparatus was not designed so much for rescue work, but for transporting purposes for use by the operators of moving vans for hauling household articles, such as furniture, office equipment, and the like, so as not to interfere with the normal passenger elevator traffic pattern of the building. This apparatus includes a cable drive system that is associated with a power supply that is a permanent part of the building utilities and services.

The Lyons U.S. Pat. No. 4,018,306 describes emergency building access apparatus having a plurality of modifications of vertical railroads that permit ready access to a high-rise building during fire and rapid evacuation of occupants. This apparatus utilizes exposed hoisting cables and/or exposed electrical power supply cables.

OBJECTS OF THE PRESENT INVENTION

The principal object of the present invention is to provide an outside rescue elevator system for a high-rise building where a portable elevator cab is used which has stabilizing wheels on its lower portion for riding on a smooth vertical roadbed that is created on the exterior wall of the building.

A further object of the present invention is to provide a rescue elevator system of the class described with a dual compartment track vertically mounted on the building with a wheeled truck that operates in one compartment, and a dual cable system is provided in both compartments of the track for raising and lowering the truck, where the elevator cab is joined to the truck as its means of support.

A further object of the present invention is to provide an elevator system of the class described where the stabilizing wheels of the elevator cab are horizontally adjustable to accommodate different exterior wall surfaces of the many buildings that may be serviced by the this same elevator system.

A further object of the present invention is to form the portable elevator cab as a portion of a mobile unit which includes a truck and a self-propelled motor/generator set for providing an independent motive power for the cable hoist system that is independent of the power systems available in the building.

A further object of the present invention is to provide an outside rescue elevator system having a single mobile unit for servicing a plurality of high-rise buildings.

A still further object of the present invention is to provide in combination with the outside rescue elevator system a refuge area on certain of the floors of the building for protecting the occupants of the building from fire and smoke during an emergency until the elevator system can evacuate the occupants.

SUMMARY OF THE INVENTION

The present invention provides an outside rescue elevator system for a high-rise building that includes a dual compartment track with a dual cable system and a wheeled truck in one compartment and a portable elevator cab connected to the truck, where the cab is provided with stabilizing wheels for riding upon a smooth vertical roadbed on the exterior surface of the building.

BRIEF DESCRIPTION OF THE DRAWINGS

This invention will be better understood from the following description taken in conjunction with the accompanying drawings, and its scope will be pointed out in the appended claims.

FIG. 6 is a fragmentary elevational view, on an enlarged scale, of the elevator track showing the details of the nature of the track extending from the street level of the building, all the way up to the roof level where the track extends above the parapet wall so that the elevator cab may discharge its passengers onto the roof of the building for their protection and possible evacuation by means of helicopter or the like.

FIG. 7 is a schematic diagram of the cable hoist system, which includes sheaves at the top and bottom of the hoist sytem, as well as a wheeled truck to which the portable elevator cab is connected.

FIG. 15 is a fragmentary cross-sectional plan view, on an enlarged scale, of the elevator track of FIG. 9 showing it with a vertical exterior flange that cooperates with a manual braking system that is built into the elevator cab for use by the passengers of the cab in the case of an emergency of the cable hoisting system.

FIG. 16 is a front elevational view, taken on the line 16—16 of FIG. 15, showing the nature of this manual braking system.

DESCRIPTION OF THE PREFERRED EMBODIMENTS

Figure 1:
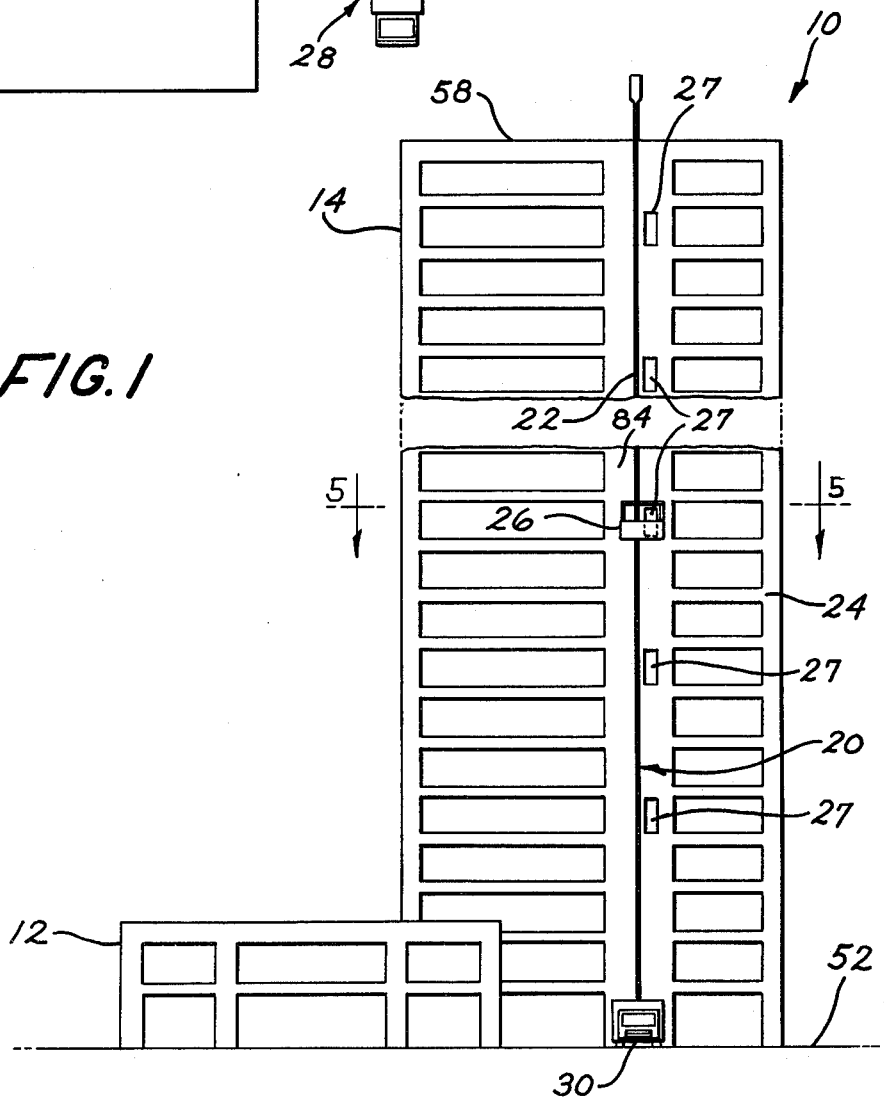
FIG. 1 is a front elevational view of a high-rise building that is shown furnished with an outside rescue elevator system of the present invention for use in fire and other disaster emergencies.

Turning now to a consideration of the drawings, and, in particular, to the front elevational view of FIG. 1, there is shown a high-rise building 10 having a low level entrance and assembly area 12 and a tower 14 depicting a standard office building, hotel or apartment building. There is a growing awareness in this country that high-rise structures present special dangers to occupants, visitors and fire fighters because of the rapid spread of fire, smoke and toxic gases. Ironically, many fire-retardant treatments of furniture and building materials generate huge volumes of smoke and carbon monoxide. Combustible gases can build up in the space between the ceiling and floor above until they explode. This phenomenon is frequently described by fire fighters as the "fireball" in high-rise buildings. When a fire alarm is sounded in a typical high-rise building, present fire-fighting procedures are that all smoke and separation doors held open by magnetic devices release to allow these doors to close automatically. Most elevators return to the first floor in order to allow the fire fighters ready access to the upper floors where fire has occurred. None of these elevators will answer calls from the upper floors. Stairways are available for able-bodied occupants to use for escape. Experience has shown that both elevator shafts and stairways become powerful chimneys for the heated gases that are generated by a fire. Thus, the avenue for escape and fire fighting is effectively blocked. Building safety can be improved by installing sprinklers, but sprinklers are not activated by smoke, and smoke detectors do not extinguish smoke or fire.

The present invention relates to an outside rescue elevator system 20, which is shown installed on the exterior of the tower 14 of FIG. 1. This elevator system comprises a dual elevator track 22 of double box-beam configuration which is vertically mounted on the exterior wall 24 of the tower. Cooperating with this track 22 is a portable elevator cab 26, which is usually coupled to the track system only during an emergency situation. Special building exit doors 27 are shown in the exterior wall 24 adjacent the elevator track 22 for evacuating the occupants of the building into the elevator cab 26. Every floor of the building may not have an exit door 27. Depending upon the population or census of the building 10, there may be multiple outside rescue elevator systems 20, as is seen in the top plan view of FIG. 2.

The present invention envisions that the portable elevator cab 26 will be a universal design that is capable of operation on high-rise buildings with exterior walls of different configurations. This elevator cab 26 is made portable so that it can be easily connected and disconnected from the vertical track system and moved around from place to place. Looking at FIG. 3, the elevator cab 26 is shown as part of a mobile unit 28 which comprises a self-propelled service truck 30 that is capable of pulling a trailer 32 that includes a motor/-generator set 34 that includes an internal combustion engine 36 that is capable of driving an electric generator 38 that in turn powers an electric motor 40 that has a drive shaft 42. The portable elevator cab 26 is adapted to be mounted onto the motor/generator set 34 and to travel therewith from one place to the other. It is considered best that this mobile unit 28 be in the custody and under the control of the city fire rescue squad, and that for a medium size city there would be two or three such mobile units 28 that are maintained at central locations for serving the high-rise buildings of an entire city. Each such high-rise building, such as 10, would be provided with the elevator track system 22, but without the portable elevator cab 26. Additional mobile units could be brought in from neighboring cities as emergency backup in much the same way as fire trucks are logistically utilized. The training of personnel, the operation of the mobile units, and the service of this equipement would be performed by the fire rescue squads, instead of being left to the discretion of the individual building owners and operators. The service truck 30 is a large van type vehicle, and it would be supplied with all of the necessary supporting equipment, such as gas masks, oxygen tanks, fire axes, ladders, medical equipment, stretchers and the like.

Figure 3:
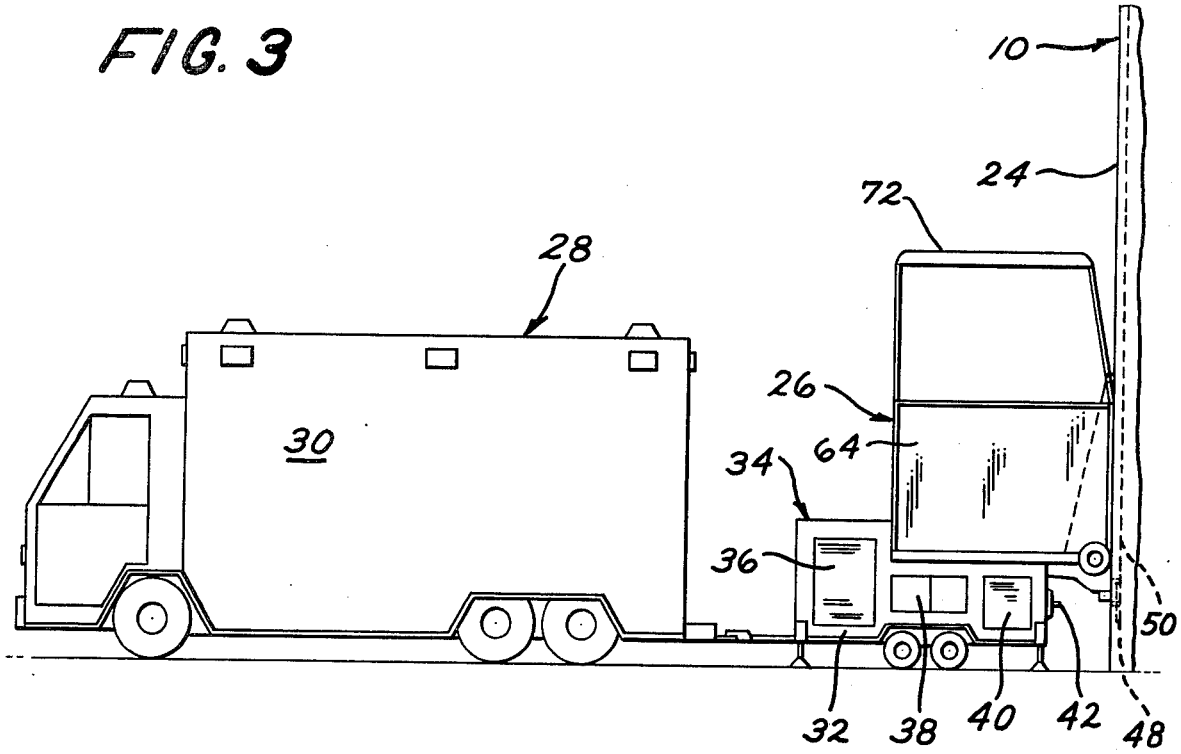
FIG. 3 is a fragmentary elevational view, on an enlarged scale, at the street level of the building of FIG. 1 showing a mobile unit comprising a portable elevator cab carried on a trailer that includes a motor/generator set that is towed by a self-propelled service truck. This mobile unit is shown positioned at the base of the vertical track of the elevator system for coupling the elevator cab to the vertical track.
Figure 4:
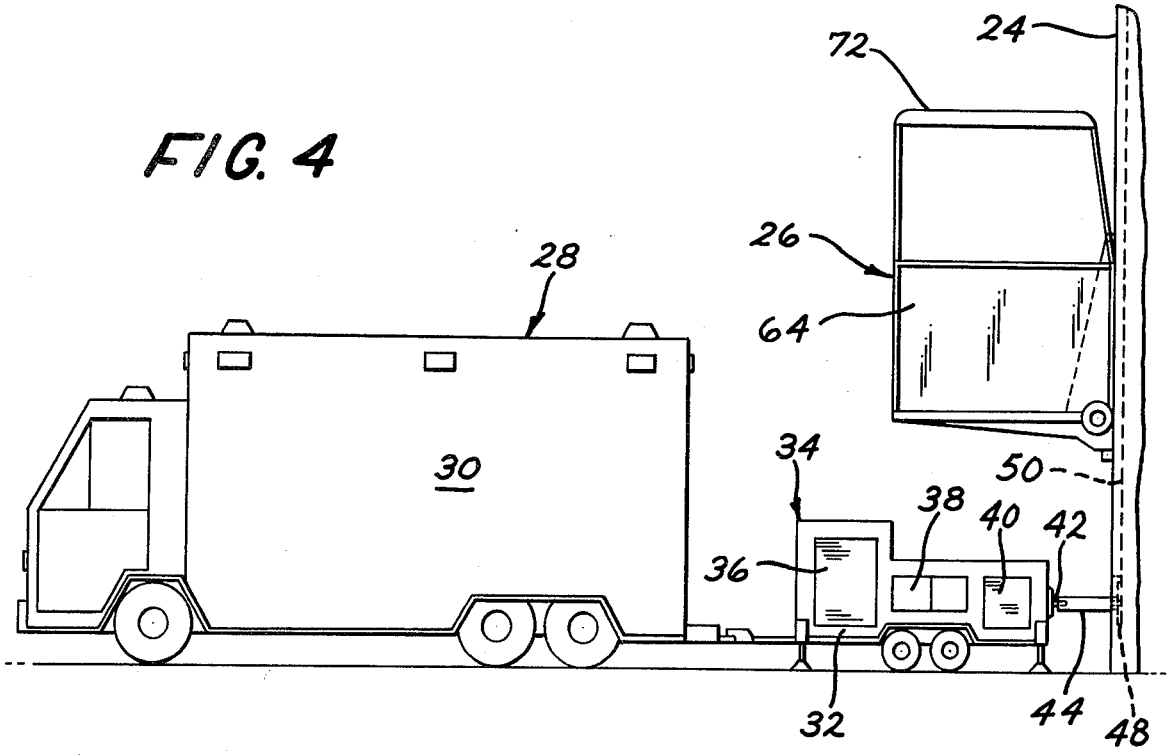
FIG. 4 is a fragmentary elevational view, similar to that of FIG. 3, showing the motor/generator set coupled to the cable hoist system of the elevator, as well as showing the portable elevator cab joined to the track system and having risen off of its supporting trailer for climbing up the wall of the building.

FIG. 4 is an elevational view, similar to that of FIG. 3, showing the drive shaft 42 of the electric motor 40 provided with a coupling shaft 44 for coupling with the lower sheave 48 of the elevator cable hoist system 50, which will be described in detail with relation to FIGS. 6 and 7. Notice that the elevator cab 26 has been coupled to the elevator track system and has risen off of the motor/generator set 34. The control for this cable hoist system 50 is preferably by radio control (not shown), either located on the mobile unit 28, or remote therefrom, as by a hand-held set, or located within the elevator cab 26.

Figure 5:
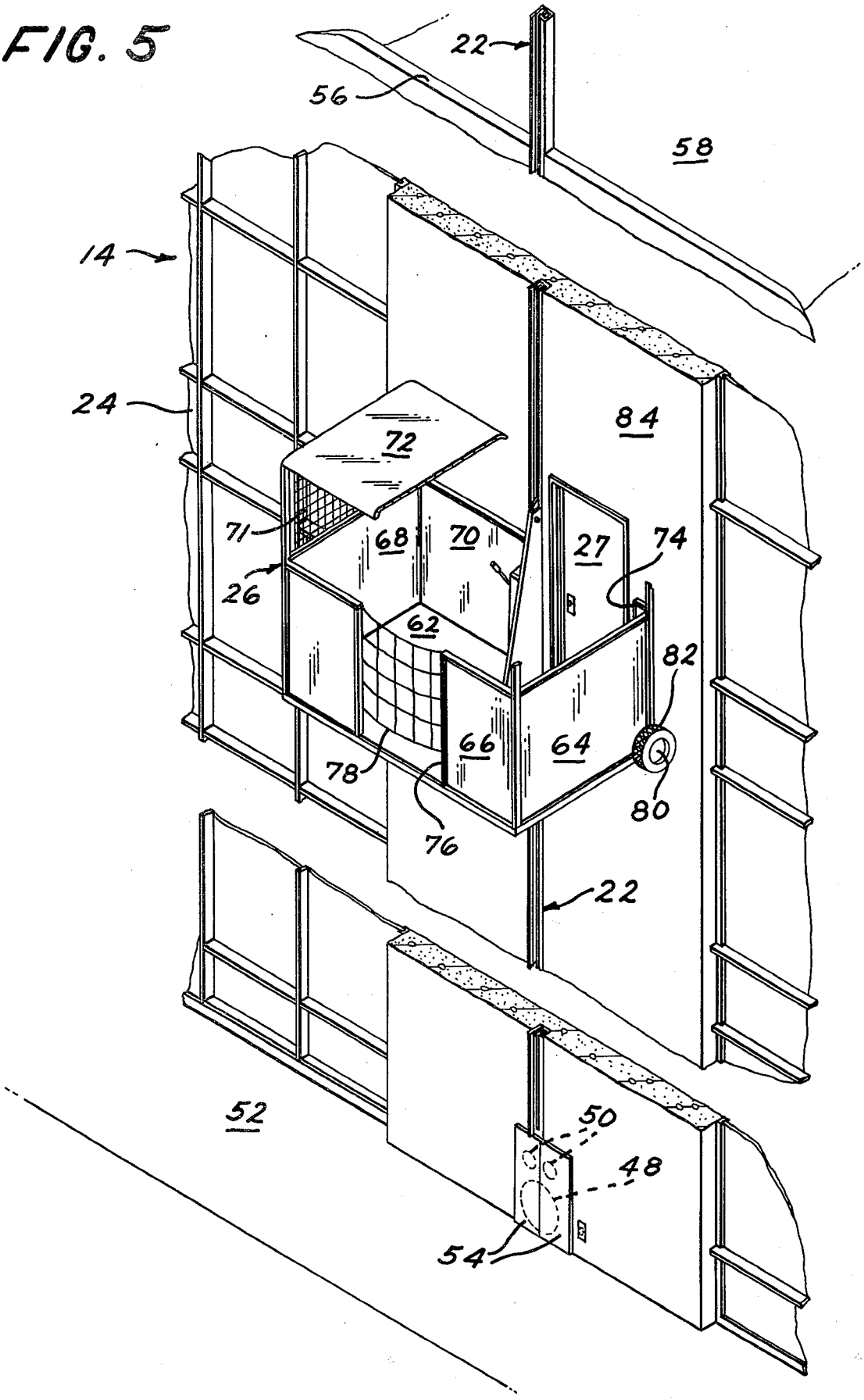
FIG. 5 is a perspective view of a fragment of the exterior surface of the building, taken on the line 5—5 of FIG. 1, showing more of the details of the elevator track and cable hoist system, as well as the portable elevator cab and the smooth vertical roadbed over which the elevator cab travels, as well as showing the exit door from the building that is located within the smooth vertical roadbed for use in evacuating the occupants of the building to the exterior elevator cab.

FIG. 5 is a fragmentary perspective view of the exterior wall 24 of the tower 14, with parts broken away. The bottom of this FIGURE shows the ground level 52. The vertical elevator track 22 has a lower end that is protected from vandals by a pair of utility doors 54, which, when opened, expose the lower sheave 48 and the related parts of the elevator cable hoist system 50. Notice that the top end of the elevator track 22 rises above the parapet wall 56 and the roof 58 of the building; the purpose being so that the elevator cab 26 may evacuate people onto the roof 58 for temporary protection from the smoke and fire until the emergency is over, or helicopters may be brought in to remove the people from the building. The elevator cab 26 is shown suspended from the track system 22. This cab is shown with a floor 62, and four side walls 64, 66, 68 and 70, which are provided with raisable cab panels 71 of screen wire formation so as to improve the visibility of the passengers of the elevator cab during its operation. Preferably, the cab 26 is provided with a roof 72 for protecting the passengers of the cab from falling objects. The innermost side wall 70 of the cab has a doorway 74 for gaining access to the exit door 27 on the various floors of the tower 14. The outermost wall 66 has a central access opening 76 with a removable gate 78.

An important feature of the elevator cab 26 of the present invention is that the lower portion of the cab adjacent the innermost wall 70 is provided with a pair of stabilizing wheels 80 which have pneumatic tires 82. These wheels are adapted to have rolling contact with a vertical, smooth roadbed 84 on the exterior wall 24 on both sides of the vertical track 22, as is clear in both FIGS. 1 and 5.

Figure 8:
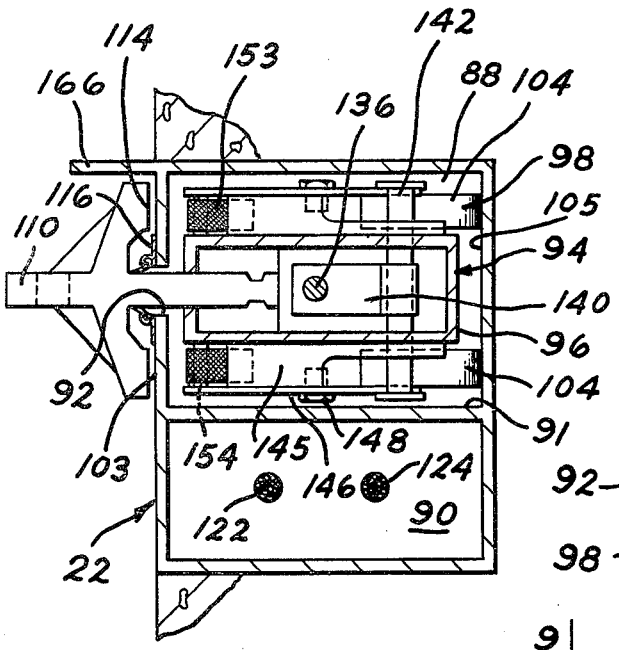
FIG. 8 is a fragmentary elevational view of the upper end of the wheeled truck, on an enlarged scale, with parts of the track shown in cross section, taken on a vertical plane that extends out through the open vertical slot in one compartment of the dual track, to show the nature of the rolling contact of the wheels of the truck with the interior walls of the track, as well as showing the upper coupling means for the elevator cab, and the emergency braking system that is operated automatically in the event of a cable failure.

FIG. 6 is a fragmentary, elevational view of the vertical elevator track 22 with the central part broken away, since the track is of generally uniform configuration, except for the special treatment at the bottom, and the special treatment at the top. As is best seen in the top cross-sectional plan view of FIG. 9, this elevator track 22 has dual compartments 88 and 90 that are separated by a web or partition 91. The first compartment 88 is at the left side of the track when the track is viewed from the front, as is seen in FIG. 6. This compartment 88 is provided with a narrow, longitudinal slot 92 which extends from one end of the track to the other, as is clear in FIG. 6. This first compartment 88 serves to support an elongated, wheeled truck 94 for travel therein, as is best seen in FIGS. 7–12. This wheeled truck 94 is formed of an elongated box beam 96 that is furnished with a top group of four rollers 98, and a bottom group of four rollers 100, as is best seen in FIG. 7. The top group of four rollers 98 has two parallel front rollers 102 and two parallel rear rollers 104, as is best seen in FIG. 8. The front rollers 102 are in rolling contact with the interior surface of the front wall 103 of the first compartment 88, while the two rear rollers 104 are in rolling contact with the interior surface of the rear wall 105 of the first compartment 88.

Figure 9:
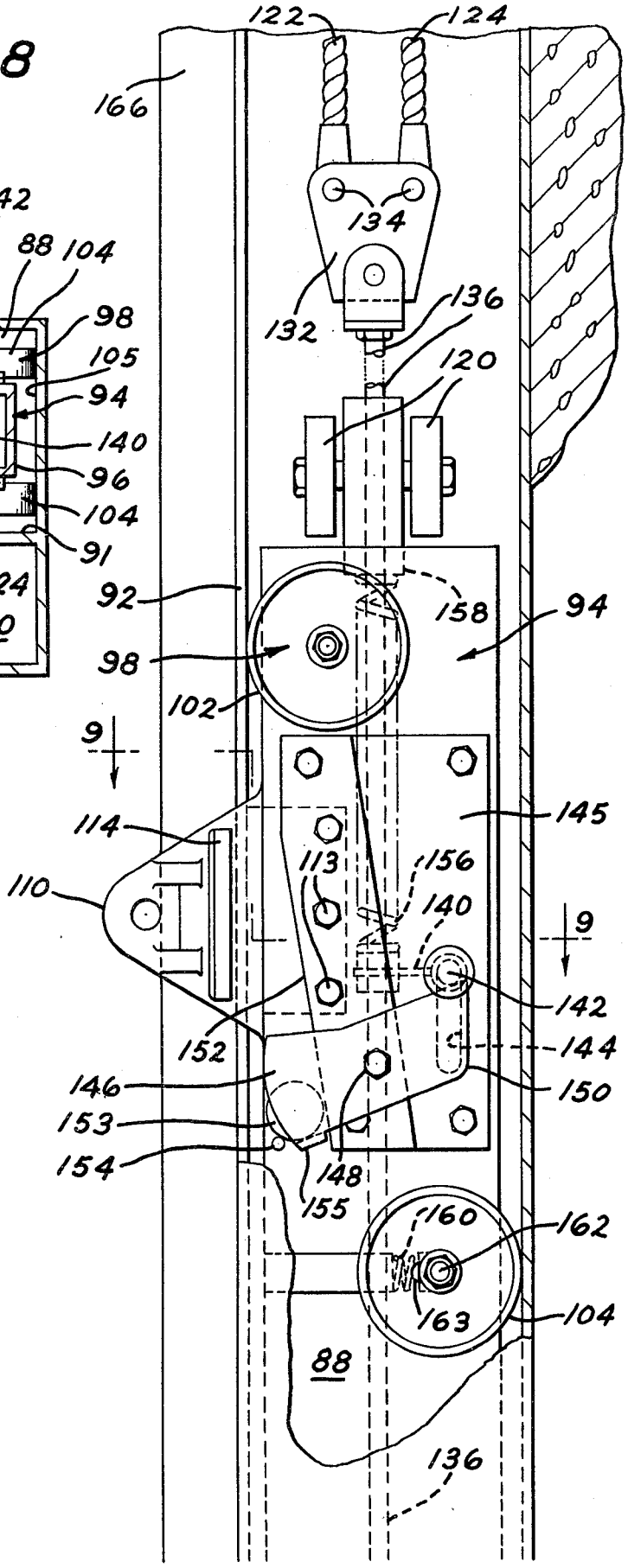
FIG. 9 is a transverse, cross-sectional plan view of the vertical elevator track, taken on the line 9—9 of FIG. 8, on an enlarged scale, to show the nature of the dual compartment track with the wheeled truck located in one compartment and the pair of cables positioned in the second compartment so as not to interfere with the operation of the truck. A narrow, elongated slot is shown in the exterior wall of the first compartment, and the truck is shown with a coupling means extending through the slot for coupling engagement with the portable elevator cab.
Figure 10:
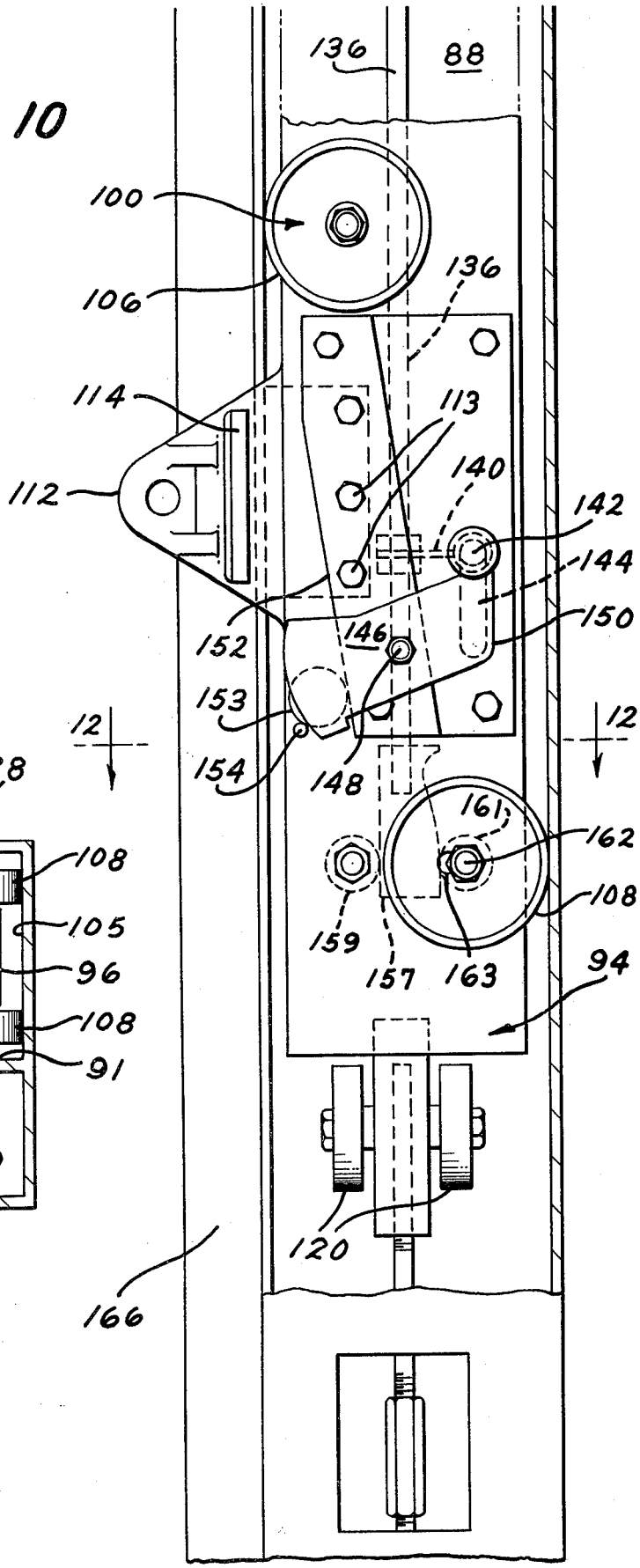
FIG. 10 is a fragmentary elevational view of the lower end of the wheeled truck, similar to that of FIG. 8, to show the lower coupling means and the remainder of the emergency braking system that operates in the event of a cable failure.

In a similar manner, as seen in FIG. 10, the bottom group of four rollers 100 has two parallel front rollers 106 in contact with wall 103 and two parallel rear rollers 108 in contact with wall 105. Notice in FIG. 7 that the wheeled truck 94 has two coupling tongues 110 and 112 which are used for coupling the portable elevator cab 26 to the wheeled truck 94. Tongue 110 is positioned near the top group of rollers 98, while the second tongue 112 is grouped near the bottom group of rollers 100. Each tongue is of rather narrow construction so that it may fit through the narrow, elongated slot 92 in the elevator track 22, as is clear from FIG. 9, and be bolted to the box beam 96 by through bolts 113. The narrow, elongated slot 92 is furnished with a resilient closure 116, as best shown in FIG. 9, in the form of a pair of rubber gaskets that have a butting relationship with each other for serving as an all-weather seal for the pair of cables 122 and 124 within the first track compartment 88, as well as the wheeled truck 94. Of course, this resilient closure 116 will be deflected open by the coupling tongues 110 and 112 as the truck 94 travels up and down the track 22. Heavy side reinforcements 114 are formed on each tongue in the area outside the slot 92 to give each tongue strength as well as to serve as brake shoes against the outer surface of the walls 103 of the track, as will be explained later.

It is also important to provide the wheeled truck 94 with side stabilizing rollers 120 which are located at both the top and bottom of the truck, as is clear from FIGS. 7, 8 and 10. Accordingly, the wheeled truck 94 has rollers in rolling contact with all four walls of the first track compartment 88.

With particular reference to FIGS. 6 and 7, the wheeled truck 94 is powered by an endless cable hoist sytem 50 having a lower V groove driving sheave 48 that is provided with a flexible cable 122 of long-wearing material, such as Monel. The preferred design of the present invention employs a dual, parallel cable system having two cables 122 and 124, as is clear from FIG. 9. Each cable 122 and 124 parallels the other so as to represent a redundant cable hoist system that will be available, if by chance one cable were to fail. The remaining cable would suffice to carry the load until the cable system could be disassembled and repaired. Each cable 122 and 124 is wrapped completely around the driving sheave 48 for improved traction capability.

The second track compartment 90 of FIG. 9 is designed to carry one run or pass of both cables 122 and 124 so that the wheeled truck 94 will be free of interference from the cables during the fast, vertical travel of the truck within the first track compartment 88. Accordingly, there would be two lower driving sheaves 48, as well as a comparable pair of driven sheaves 126 at the top of the truck 22, as is clear from both FIGS. 6 and 7. Two pairs of alignment sheaves 128 are located at the bottom of the cable system near the lower sheaves 48, and a similar grouping of two pairs of alignment sheaves 130 are located adjacent the top pair of sheaves 126. Thus, the second run of the cables 122 and 124 are positioned in the first track compartment 88. Looking at the top of FIG. 8, the ends of the two cables 122 and 124 are joined to a terminal plate 132 by means of locking pins 134. The terminal plate 132 is connected to a tension bar 136 which extends down into the top of the elongated box beam 96 of the wheeled truck 94.

This tension bar 136 is one element of an emergency braking system for both the truck 94 and its elevator cab 26, as is illustrated in both FIGS. 8 and 10. Positioned on the tension bar 136 is a bracket member 140 which supports a transverse, elongated bolt 142, the two ends of which are positioned within a vertical slot 144 in the opposite walls of the box beam 96, as well as in the heavy side plates 145. Pivoted to the side of each heavy side plate 145 is a pivoted plate member 146, by means of a central pivot bolt 148. The rear end 150 of the pivoted plate member 146 underlies the bolt 142. The front edge 152 of the heavy side plate 145 is a tapered surface. A knurled braking roller 153 is positioned at the lower end of the tapered surface 152, and it is confined there by a small pin 154. The front end of the pivoted plate member 146 has a flange 155 which underlies the roller 153. In the event the cables 122 and 124 break, the spring 156 pushes the bolt 142 down, which in turn pivots the plate members 146 to raise the two knurled rollers to wedge them tightly between the wall 103 and the tapered surface 152. A heavy-duty compression spring 156 is fitted around the tension bar 136 between the bracket member 140 and the top portion 158 of the box beam 96 of the wheeled truck 94. In the event the two cables 122 and 124 were to break, the wheeled truck 94 would fall rapidly, and the compression spring 156 would expand to force the bolt 142 down the slot 144. Cooperating with these two braking rollers 153 are the two rear rollers 104, which are shown as being spring-loaded by spring means 160, to complement the emergency braking action of the rollers 153. The axle 162 of the rear rollers 104 is captured in an elongated slot 163 to give these rollers 104 lateral movement capability. If the cables were to break, this emergency braking system would automatically become operative, and the knurled rollers 153 would become wedged tight in place causing the rear wheels 104 to compress inwardly so the box beam 96 will shift to pull the side reinforcements 114 of the coupling tongue 110 into braking engagement with the wall 103 of the track, in the manner of a brake shoe.

Figure 11:
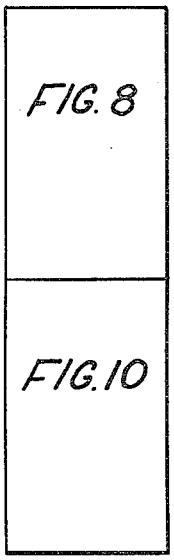
FIG. 11 is a schematic diagram showing how the FIGS. 8 and 10 are to be viewed together, since they appear on separate sheets of drawings.
Figure 12:
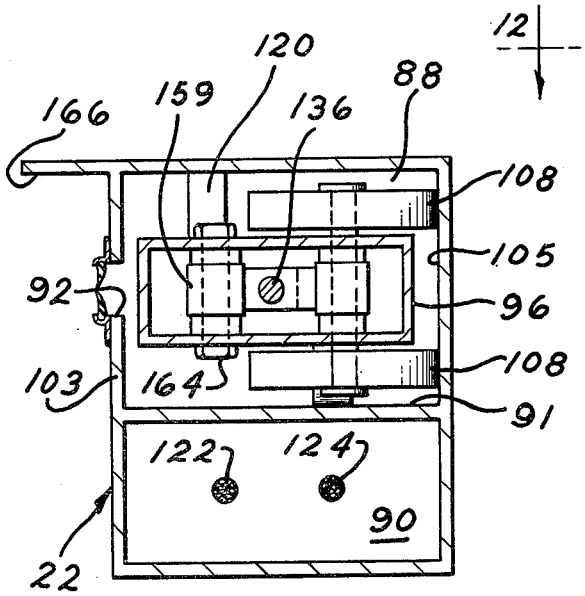
FIG. 12 is a transverse, cross-sectional plan view of the elevator track, taken on the line 12—12 of FIG. 10, showing how the lowermost rollers are allowed to retract in the event the cables break and the emergency braking system is rendered functional so as to stop the travel of the elevator cab.

There is a second emergency braking system in the lower end of the wheeled truck 94, as is shown in FIGS. 10 and 11, for cooperation with the lower coupling tongue 112. The elements in this second braking system, which are common to the first braking system, are given the same reference numerals. One main difference is that the lower end of the tension bar 136 is fitted with a wedge 157 that is confined between two roller bearings 159 and 161. The roller bearing 158 is supported by a through bolt 164, as seen in FIG. 12. The second roller bearing 161 is supported on the axle 162 of the pair of rear rollers 108. This axle 162 is supported in the horizontal slots 163. In the event the cables 122 and 124 break, the tension rod 136 would shift downward, and the upper, narrow end of the wedge 157 would permit the rear rollers 108 to shift inwardly so the brake shoes 114 of the coupling tongue 112 would engage the front wall 103 of the track in a manner similar to the top braking system.

Attention is directed to the transverse, cross-sectional plan view of FIG. 9. Notice the forward flange 166 that extends outwardly of the side edge of the first track compartment 88. This forward flange 166 extends for nearly the complete length of the track 22, as is clear from the front elevational view of FIG. 6. This flange or fin 166 is provided for use with a manual braking system that is carried on the elevator cab, as is illustrated in FIGS. 15 and 16. Rigidly mounted on the elevator cab is a box-like housing 168 in which is supported the hand brake 170, which includes a pivoted lever 172 having a pivot 174 that is fixed to a reinforced beam 176 within the housing 168. A pair of pivoted brake shoes 178 are centered on opposite sides of the pivot 174 for engaging the opposite sides of the forward flange 166 of the track, when a downward pressure is applied to the pivoted lever 172. A tension spring 179 is supplied with the pivoted lever 172 to normally hold it in an upward, inactive position. The upper end 177 of this spring 179 is fixed within the housing 168. In order to obtain an increased mechanical advantage, a second pivoted lever 180 may be employed to complement the first lever 172. This second lever 180 would have a pivot pin 182 that would be integral with a portion of the housing 168, but this is not illustrated in FIG. 15 in order not to complicate this view. A second tension spring 184 is provided between the handle of the second pivoted lever 180 and the housing 168 for normally holding this second lever in an inactive position until manual force is applied.

Figure 13:
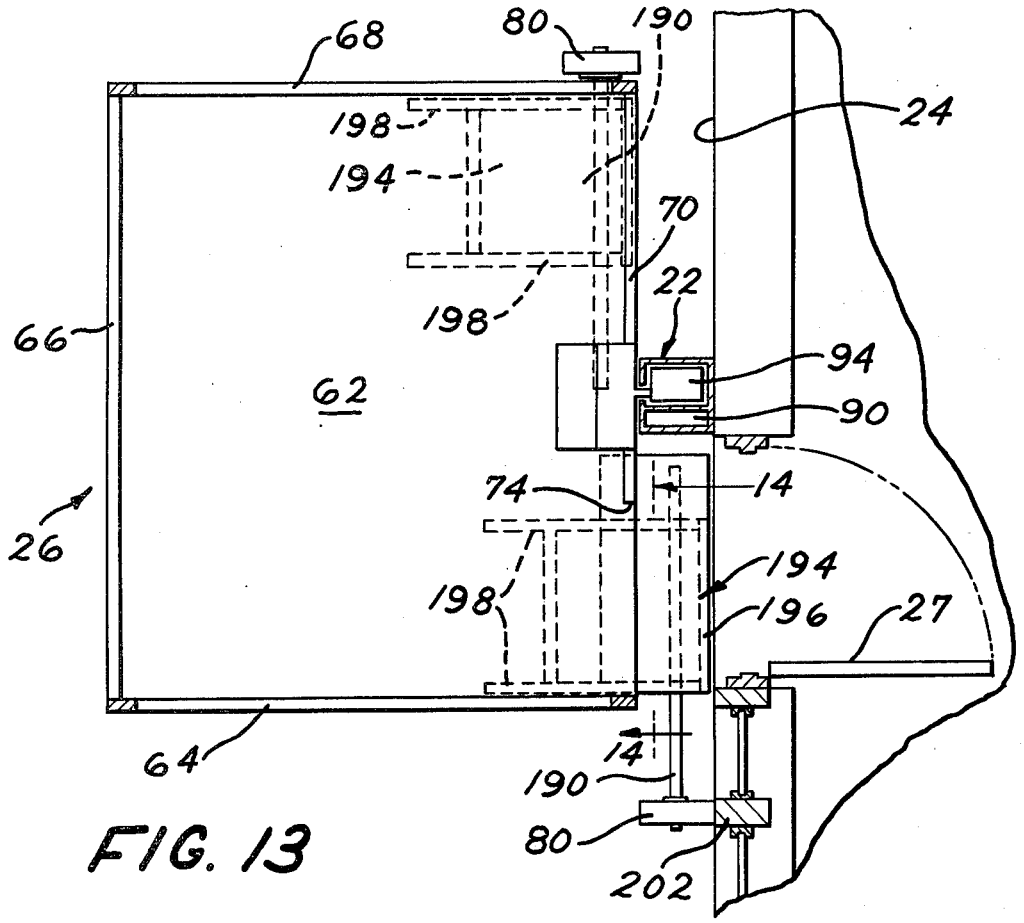
FIG. 13 is a fragmentary cross-sectional plan view, with the roof removed, of the portable elevator cab mounted to the elevator track on the exterior of a building, and showing the nature of the adjustable stabilizing wheels of the cab for accomodating wall surfaces of different configuration on the exterior of the building, since this elevator cab is a universal design to be used with a plurality of high-rise buildings of different constructions.
Figure 14:
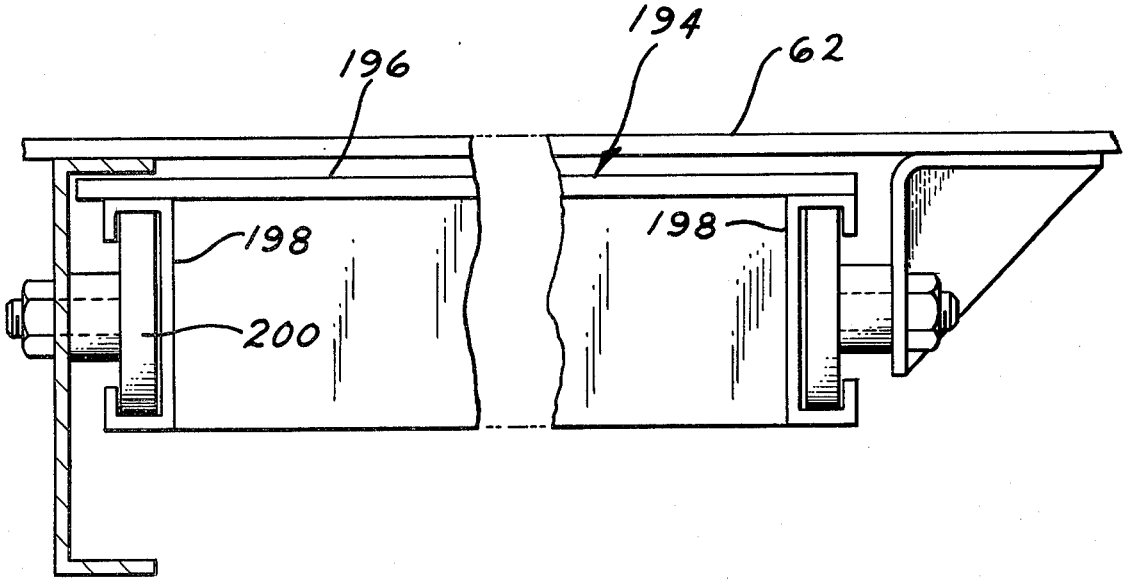
FIG. 14 is a fragmentary elevational view, on an enlarged scale, of a portion of the floor of the elevator cab showing a cab floor extension section that supports one of the wheels of the cab, taken on the line 14—14 of FIG. 13.

Looking at FIG. 13, there is shown a top, cross-sectional plan view of the elevator cab 26 taken at about mid-height of the cab. As mentioned above, the cab has a floor 62 and vertical side walls 64, 66, 68 and 70, with a doorway 74 in the wall 70 for gaining access to the exit door 27 in the exterior wall 24 of the tower 14. The elevator track 22 is shown mounted on an existing building as it is exposed on the exterior wall 24 of the tower 14. If this elevator track system were to be installed in new construction, the track 22 would preferably be recessed within the exterior wall so as to be less visible. It will be appreciated by those skilled in this art that most, if not all, high-rise buildings have different surface configurations so that some renovation will have to be made in order to provide a smooth roadbed 84, as was illustrated above in FIG. 5 for a new construction building. It is preferred that the elevator cab 26 will have a pair of stabilizing wheels 80 which will be horizontally adjustable to accommodate different exterior wall configurations on different buildings that are to be serviced by this rescue elevator system. In FIG. 13, the stabilizing wheels 80 are shown in different positions. Each wheel is mounted on a shaft or axle 190 which is supported from a floor extension platform 194. This floor platform 194 is positioned below the floor 62 of the elevator cab, and it has a top panel 196 supported on a slide rail or channel 198 along each side edge, as is best seen in FIG. 14. Suitable support rollers 200 are fixed under the floor 62 of the cab and are confined within these slide rails 198 so that these rails, with the top panel carried thereon, may slide in and out, as is shown in the dotted line positions of FIG. 13. Hence, the floor extension platform 194 may be shifted horizontally toward and away from the exterior wall 24 of the building. Moreover, the shaft or axle 190 of the stabilizing wheels 80 may be shifted longitudinally thereof to move the wheel to align itself with a mullion or other track element 202 which may serve as part of a vertical, smooth roadbed for the elevator in its travel up and down the side of the building 10.

Figure 17:
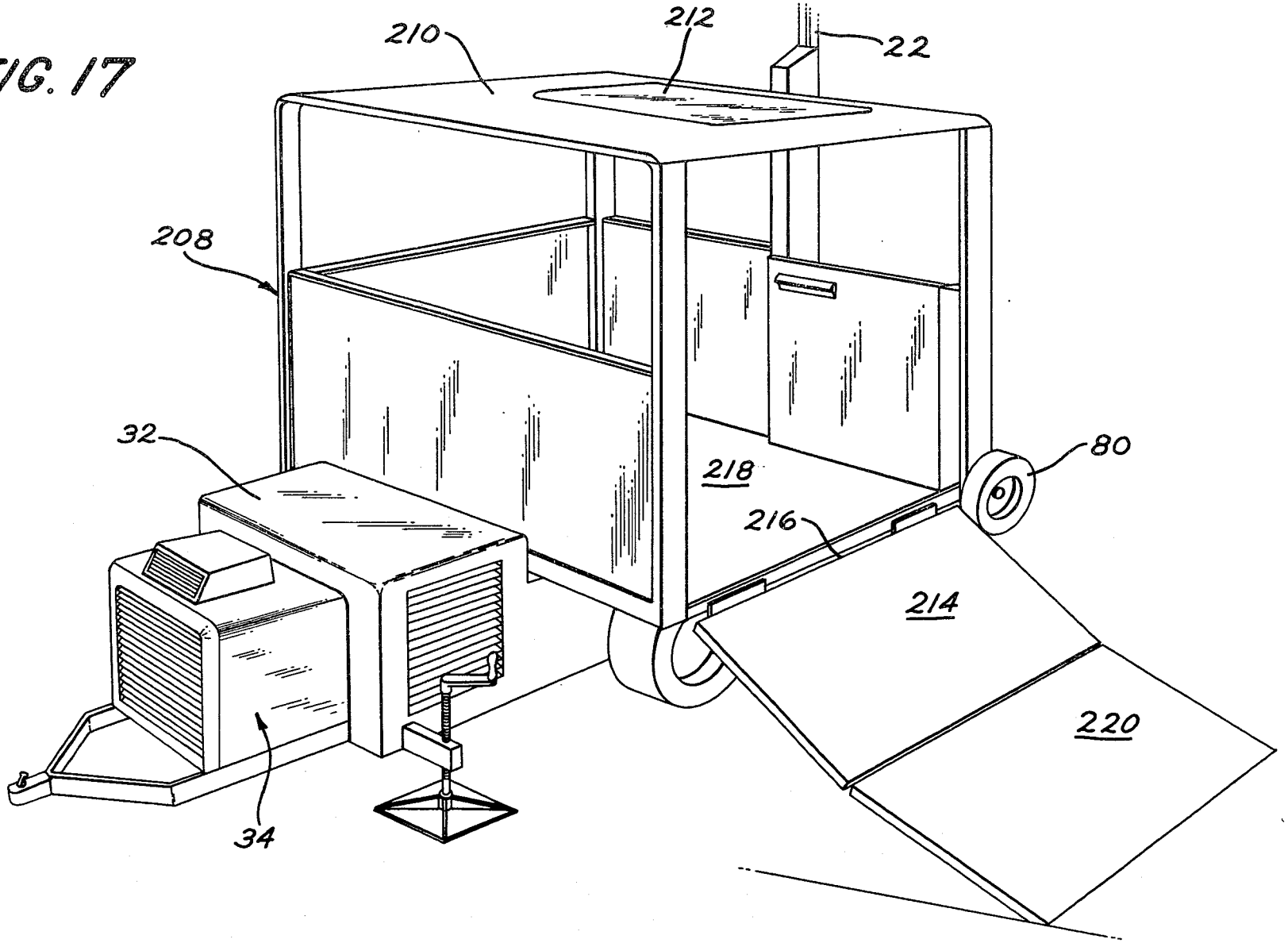
FIG. 17 is a perspective view of the trailer that includes the motor/generator set on which the portable elevator cab is mounted during transit, and the cab is shown as having one side wall that is hinged along its bottom portion so that the wall may be convertible into an inclined ramp for loading and unloading the elevator cab at the street level.

FIG. 17 shows another modification of a portable elevator cab 208. It is shown supported on the same trailer 32 with its motor/generator set 34, as was illustrated in FIG. 3 above. This cab has the same adjustable stabilizing wheels 80, but it has a roof 210 with a transparent panel 212 for use by the passengers in this cab so they may have upward vision of the building exterior during the operation of the cab. Another important feature of this cab 208 is the hinged side wall 214 which may be hinged along its bottom edge 216 to the floor 218 of the cab. This side wall 214 has a second hinged section 220 so that when the first section 214 is folded down, it forms an inclined ramp that leads from the cab floor 218 to the ground and provides a safe and rapid means for moving passengers and equipment to and from the cab.

Figure 2:
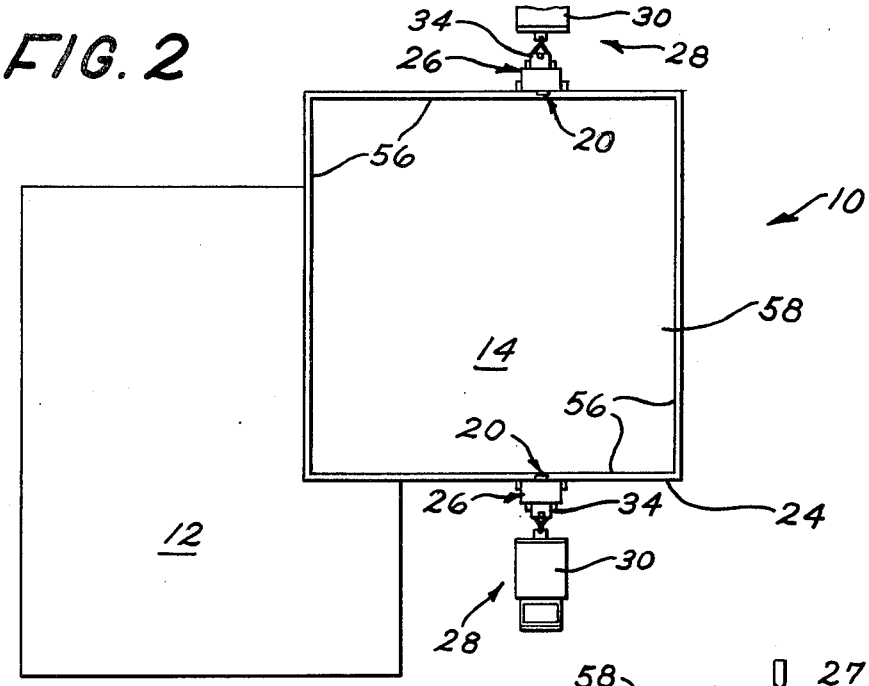
FIG. 2 is a top plan view of the building of FIG. 1 showing a pair of outside rescue elevators operational on opposite exterior walls of the building.
Figure 18:
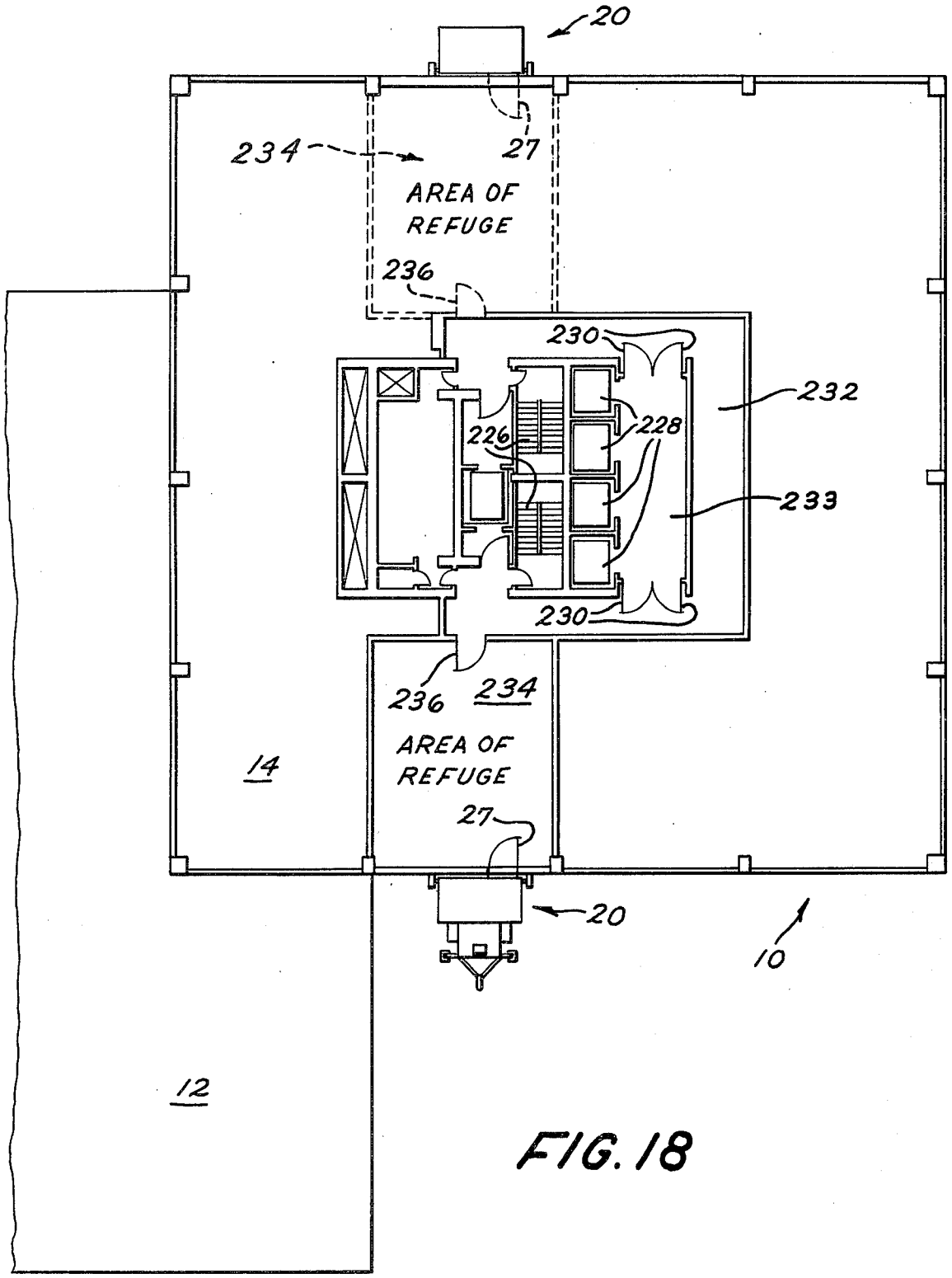
FIG. 18 is a fragmentary cross-sectional plan view of a high-rise building showing the floor plan of one of the floors of the building with the outside rescue elevator system of the present invention in place, in combination with a refuge area that is isolated from the remainder of the floor so as to prevent the penetration of fire and smoke into the refuge area to threaten the lives of the occupants of this area during an emergency. This FIGURE likewise illustrates improved safety means by way of automatic closing doors and bypass corridors for isolating the stairwell and elevator shafts from the corridors for use by the building occupants during an emergency for gaining access to the refuge areas.

FIG. 18 shows a simplified floor plan for the tower 14 of the building 10 of FIG. 2. This building 10 is offered as an existing structure where the stairwells 226 are centrally located within the tower 14, and backed up against a bank of elevators 228.

Experience has shown that both elevator shafts and stairways become powerful chimneys for the heated gases resulting from a fire. Thus, the avenue for escape and fire fighting is effectively blocked. Pressurizing stairwells is ineffective because doors from the hallway to the stairwell are constantly being opened for rescue and escape, thus relieving pressure as each door is opened. When the fire fighters reach the scene, they will immediately hook up to the "stand pipe" located on each floor by making the hose connection in front of the building to the pumper. City water pressure is therefore supplemented by the pumper's engines. Unfortunately, the fire fighters are the only ones skilled in using the fire hose on each floor, and they find it difficult, if not impossible, to reach the fire location because, in many situations, people escaping the fire are trying to descend the stairs as the fire fighters, loaded down with gear, are attempting to get up the same stairs.

My present invention envisions the sealing off of the elevator shafts 228 from the remainder of the floor by means of automatically closing doors 230 which are actuated when the fire alarm is sounded. An additional corridor 232 is added to bypass the lobby 233 in front of the elevators 228 to provide another path to the stairwells, and for gaining access to a refuge area 234 which is provided in cooperation with the outside rescue elevator system 20 of the present invention. This refuge area 234 would have a smoke type door 236 and fire-resistant walls with no penetrations, such as air conditioning, heating ducts, electrical chases, and the like. This area could be furnished with oxygen masks and tanks, battery-operated lights, and all other types of emergency equipment for use in withstanding an emergency situation. Usually, there would not be two refuge areas 234 on the same floor. This depends on the population of the floor. However, generally, alternate floors would have refuge areas in combination with separate or independent rescue elevator system 20, as is depicted in dotted lines at the top of FIG. 15.

Figure 19:
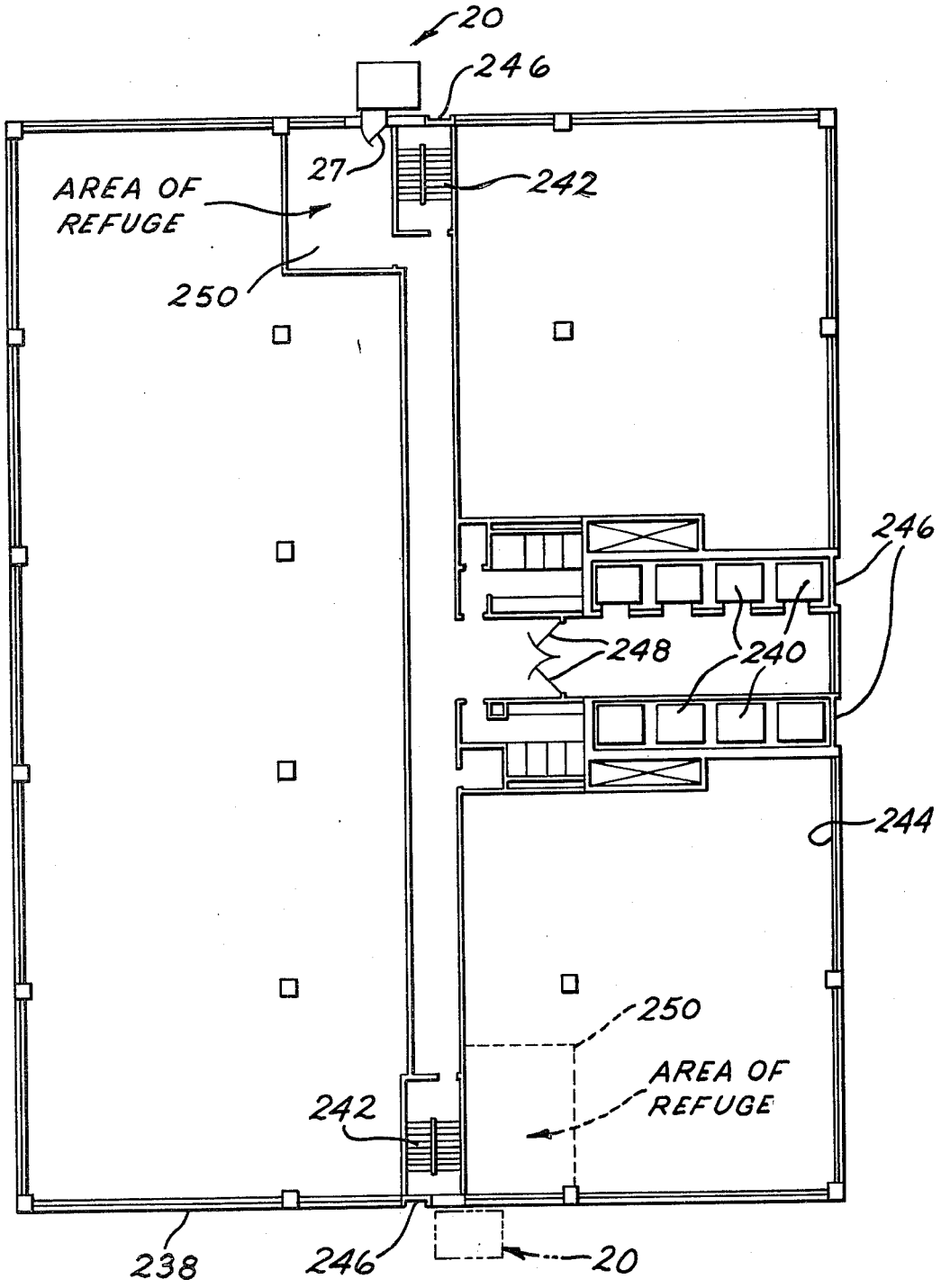
FIG. 19 is a cross-sectional plan view showing the floor plan of a new construction building with optimum architectural features to accommodate the outside rescue elevator system of the present invention where the stairwells and elevator shafts are on an exterior wall adjacent to the refuge areas and vented to the atmosphere during an emergency.

FIG. 19 is a diagrammatic floor plan for new construction where the building 238 has an outside rescue elevator system 20 at the opposite ends of the building. It is felt important in this construction to arrange the elevator shafts 240 on the exterior wall 244 of the building. Stairwells 242 are also located on the exterior walls of the building at the opposite sides of the building near the two outside rescue elevator systems 20. These stairwells assist the occupants of the building in traveling from one floor to the next in order to reach a refuge area 250 which is capable of receiving more people for evacuation by the outside rescue elevator system 20. Automatic louvers 246 would be supplied in the exterior walls for servicing both the elevators and the stairwells so that in the event of a fire these louvers would open on each floor and allow the smoke to escape to the atmosphere, so that the smoke would not endanger the occupants of the various floors, and a chimney effect would not be created that would distribute the fire and smoke throughout the building. Automatic doors 248 are provided for the elevator lobby to prevent smoke from entering the elevator shafts and/or prevent smoke within the shaft from entering the exit hallway.

Having described above a novel outside rescue elevator system for both existing high-rise buildings and for new construction, it will readily be apparent to those skilled in this art that this invention could be used during the construction of a building for moving workers and materials, or for use by maintenance or remodeling workers. Moreover, this elevator system could be used on power plant chimneys and cooling towers for the use of inspectors and technicians who read the scientific emission instruments.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. An outside rescue elevator system for a high-rise building, said system comprising:

a. a hollow, dual compartment track of double box-beam configuration in transverse view with two separate compartments, said track being adapted to be mounted vertically relative to an exterior wall of a building;

b. an elongated wheeled truck permanently positioned to travel within only one box-beam compartment of the track and having roller contact with the interior walls of said one track compartment;

c. said one compartment of the track having a narrow elongated slot in an outer wall extending longitudinally thereof;

d. the truck having coupling means extending outwardly through said slot for making engagement with a removably-attached portable elevator cab;

e. and an endless cable hoist system associated with the said dual track and including cable means in combination with sheaves mounted at both the top and bottom ends of the track, one pass of the cable means extending completely through the second box-beam compartment of the dual track and being shielded from the moving wheeled truck, while a second pass of the cable means is located within the first compartment and has free ends of the cable that are joined one to the top end of the truck and the other to the bottom end of the truck for supporting and moving the truck and its elevator cab;

f. said portable elevator cab having coupling means for joining with the coupling means of the truck, where said coupling means between the truck and the elevator cab comprises a pair of vertically spaced couplers, one adjacent the top of the cab and the other adjacent the bottom of the cab, so as to prevent the cab from wandering from its course of travel, and at least two rubber-tired stabilizing wheels carried by the lower portion of the elevator cab that are adapted to roll on smooth exterior walls of the building for gaining balance and stability of the cab during high speed movement as the elevator cab traverses the exterior of the building.

2. The invention as recited in claim 1, wherein the said endless cable hoist system is a dual, parallel cable system having two separate cable and sheave combinations, and a resilient weatherstrip closure is provided with the said narrow, elongated slot of the first box-beam compartment of the dual track for protection of the truck and cable hoist system from the elements, where said closure is opened by the passage of the coupler means extending between the elevator cab and the wheeled truck.

3. The invention as recited in claim 1, wherein each of said elevator cab wheels is mounted on a shaft that is supported from an adjustably-mounted cab floor extension section, where the extension section is adapted to be horizontally adjustable toward and away from the exterior wall of a building served by this elevator system so as to accommodate smooth wall surfaces and cooperating elevator tracks of different configurations.

4. The invention as recited in claim 1, wherein the said elevator cab wheels are adapted to be horizontally adjustable toward and away from the exterior wall of a building served by this elevator system so as to accommodate the elevator track and the cooperating smooth wall surfaces of different configurations from one building to the next.

5. The invention as recited in claim 1, wherein the said elevator cab is provided with at least one side wall that is convertible into an inclined loading and unloading ramp which reaches the street level when the cab is in its lowest street level position.

6. The invention as recited in claim 1, wherein the elevator system is adapted to be installed on a high-rise building that is provided with an exterior wall having a substantially smooth, vertical roadbed on which the wheels of the elevator cab travel, certain floors of the building having rescue elevator access doors within the said vertical roadbed, each of said elevator access doors opening into a special refuge area for protecting occupants of that particular floor from smoke and fire damage during an emergency, said refuge area having fire-resistant walls with limited openings therein so as to be sealed from smoke penetration, said refuge area having an entry door means which is substantially smoke tight when it is sealed.

7. The invention as recited in claim 1, wherein each coupling means of the wheeled truck is provided with an emergency braking system that is adapted to be actuated upon cable breakage, each of said braking systems being joined by a tension rod that is connected at its top to the dual cable means, the tension rod including a compression spring for holding both braking systems in an inactive mode, each braking system having a pair of braking rollers matched with a pair of tapered surfaces on the truck, and pivoted side plates carried by the truck for supporting the braking rollers in a lowered inactive position, whereby the breakage of the cable means allows the spring means to force the pivoted side plates to raise the braking rollers into a wedged position between the tapered surfaces and an adjacent wall of the elevator track, while simultaneously causing the two coupling means to retract and engage the adjacent track wall in a pincer action in cooperation with the braking rollers.

8. The invention as recited in claim 7, wherein the said elevator cab wheels are adapted to be horizontally adjustable toward and away from the exterior wall of a building served by this elevator system so as to accommodate the elevator track and the cooperating wall surfaces of different configurations from one building to the next.

9. The invention as recited in claim 8, wherein the said portable elevator cab is quickly attachable to the coupling means of the wheeled truck, so that the elevator cab is carried around as part of a mobile unit which includes a truck, and a motor/generator set for providing an independent motive power for the said cable hoist system.

10. The invention as recited in claim 9, wherein the said motor/generator set is mounted on a trailer that is adapted to be pulled by the truck, and the said elevator cab is mounted on the motor/generator set during transit.

11. The invention as recited in claim 10, wherein the said elevator cab has side walls with generally movable upper portions, as well as a roof portion having at least a transparent window, while the wall of the cab nearest the elevator track has a door for alignment with a mating elevator access door on certain floors of the building.

* * * * *